US005078575A

United States Patent [19]

Haas et al.

[11] Patent Number: 5,078,575

[45] Date of Patent: Jan. 7, 1992

[54] LIQUID PUMP

[75] Inventors: Roland Haas, Hofheim; Gerhard Herrmann, Schweinfurt; Elmar Mause, Schweinfurt; Armin Olschewski, Schweinfurt, all of Fed. Rep. of Germany

[73] Assignee: SKF GmbH, Schweinfurt, Fed. Rep. of Germany

[21] Appl. No.: 455,085

[22] Filed: Dec. 22, 1989

[30] Foreign Application Priority Data

Dec. 24, 1988 [DE] Fed. Rep. of Germany ..... 3843829

[51] Int. Cl.[5] ..... F04D 29/02

[52] U.S. Cl. ..... 415/197; 415/207

[58] Field of Search ..... 415/128, 182.1, 196, 415/197, 203, 207; 29/888, 888.024, 513, 521; 411/504, 505, 506, 507, 908; 403/274

[56] References Cited

U.S. PATENT DOCUMENTS

| | | | |
|---|---|---|---|
| 2,007,954 | 7/1935 | Carlson | 415/196 |
| 2,611,285 | 9/1952 | Gross | 411/505 |
| 2,812,718 | 11/1957 | Stolte | 415/182.1 X |
| 3,094,075 | 6/1963 | Logue | 415/197 X |
| 3,146,722 | 9/1964 | Warman | 415/207 X |
| 3,656,861 | 4/1972 | Zagar | 415/197 X |

*Primary Examiner*—Edward K. Look
*Assistant Examiner*—James A. Larson
*Attorney, Agent, or Firm*—Eugene E. Renz, Jr.

[57] ABSTRACT

Liquid pump assembly comprising a pump housing having a pump chamber, a drive shaft in the pump chamber mounting a pump rotor, a pump chamber cover and a molded member (12,18) partially defining the shape of the pump chamber (8) located on the inside surface of the pump cover (1).

15 Claims, 3 Drawing Sheets

LIQUID PUMP

FIELD OF THE INVENTION

The present invention relates to improvements in liquid pumps.

BACKGROUND OF THE INVENTION

Liquid pumps of the type to which the present invention relates typically comprise a pump rotor mounted on a drive shaft in the pump chamber of a pump housing, a pump cover and seal means sealing off the pump chamber. West German Auslegeschrift No. 1255995 shows a pump assembly of this general description. In this pump assembly, the pump rotor is installed on a drive shaft in the pump housing and the pump shaft is supported in a tubular projection of the pump cover. The pump cover is cup-like in shape having a conical bottom wall and a peripheral flange for receiving fasteners such as screws to secure the pump cover to the pump housing with the inter-positioning of a sealing element between the two parts. This cover design is necessitated by the fact that the cover which carries the pump rotor is guided in a housing opening and also so that the surface of the cover can be matched to the pump rotor in such a way that the shape of the pump chamber is defined with only a small gap remaining. The relatively complicated shape of the pump cover of this known design requires that the cover must either be produced from solid material or made as a casting which then requires machining if the walls are to be thick enough to insure a rigid design.

SUMMARY OF THE INVENTION

With the foregoing in mind, it is an object of the present invention to provide an improvement in pumps of the above type which eliminates some of the disadvantages and drawbacks of the prior pump designs discussed above, the improvements being directed to yield an easy to produce and an easy to assemble precision pump assembly characterized by a pump chamber providing especially good output. To this end, the pump includes a member partially defining the shape of the pump chamber located on the inside surface of the pump cover secured both axially and torsionally thereto. In one embodiment the member comprises a molded part and in another form it is wedge shaped sheet metal web. By this construction, the inside space of the pump housing is defined at least partially by the molded part or web. The advantage of this arrangement is that pump cover and the pump housing can be made of a simple, uncomplicated configuration which is easy and economical to produce. Further, the pump cover can be made of sheet metal having a substantial wall thickness without the need for excessive applied pressures or multi-stage drawing procedures. Further the pump housing can have a simplified form, for example, cylindrical with a flat bottom to which the inlets and outlets may be connected.

The molded part can be made of a variety of materials. For example the molded part can be produced easily as an injection molded plastic part or as a sintered part or as a web formed of sheet metal.

By this construction the molded part can be connected to pump cover by means of projections formed integrally therewith and function to guide the pump cover in the pump housing and adapt the shape of the cover to the pump rotor.

In accordance with a modified embodiment of the invention, the molded part may be joined to the pump cover by vulcanization. This is a particularly low cost, economical way to make the molded part which eliminates the use of screw joints which tend to cause leaks or welds which can cause warpage in the parts.

The use of a molded part also means that it can be designed so that the chamber of the pump housing surrounding the periphery of the pump rotor can be simplified to provide a means for selectively controlling the flow characteristic of the liquid being transported by the pump.

Moreover, the use of an elastomer as the material for the molded part which also has good vulcanization properties has the advantage that the outer peripheral area of the molded part can be designed as a seal so that when a cover is mounted on the housing the need for a separate sealing element is thereby eliminated. Furthermore, the molded part can also project into the tubular projection of the pump cover to provide a seal preventing escape of the liquid being conveyed. The projection also holds the bearings for the shaft and thus provides a lining for a seating surface for a sealing ring whereby a closed part with sealing action at all connecting points of the pump cover is obtained, particularly when the entire molded part is made as a single piece.

In accordance with another feature of the invention, the cover is only moderately conically formed requiring only small forming loads and a wedge shaped web is secured to the cover by suitable means such as gluing or welding.

BRIEF DESCRIPTION OF THE DRAWINGS

These and other objects of the present invention and the various features and details of the operation and construction thereof are hereinafter more fully set forth with reference to the accompanying drawings, wherein.

DETAILED DESCRIPTION OF THE PREFERRED EMBODIMENT

Figure 1:
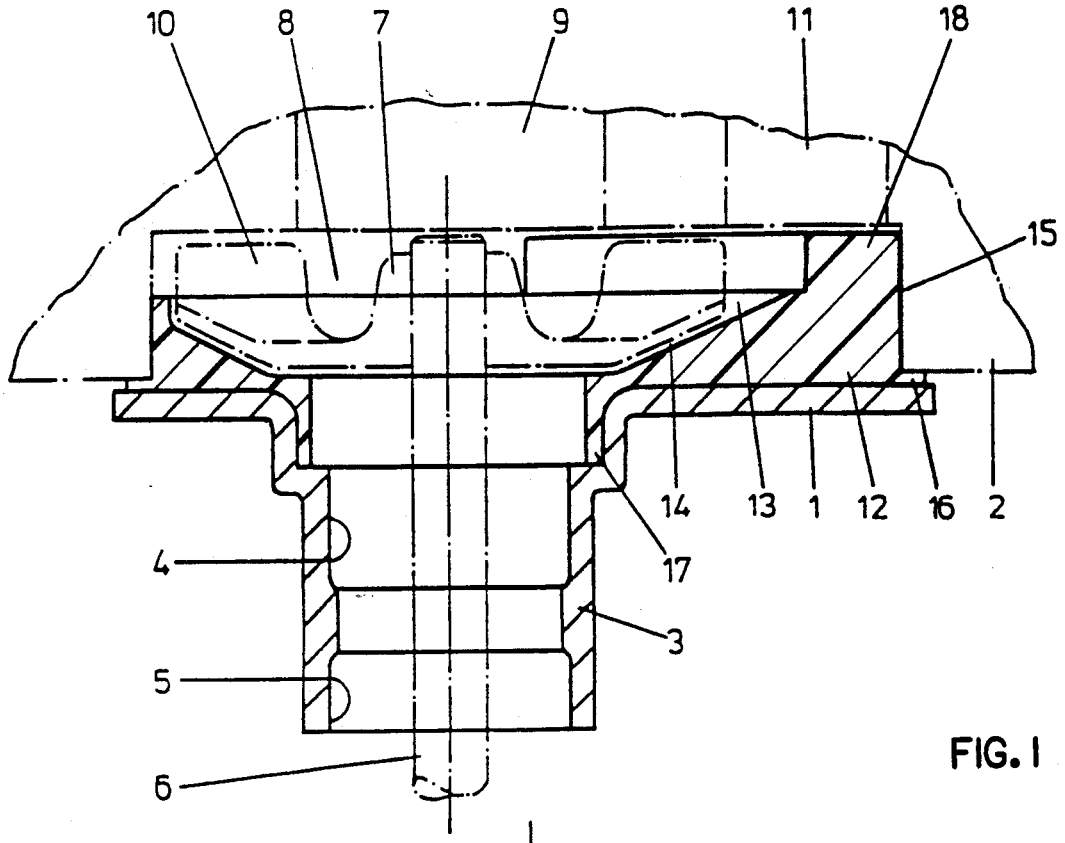
FIG. 1 shows a cross section through the pump cover of a water pump constructed in accordance with the present mention.

Referring now to the drawings and particularly to FIG. 1 thereof, there is illustrated a cooling water pump for a cooling system of an internal combustion engine including a pump cover (1) attached by means of a fasteners (not shown) to pump housing (2) shown in broken lines. Pump cover (1) has a generally cylindrical, elongated, axially outwardly directed projection (3) having axially spaced, internal bearing seats (4,5) to support roller bearings (R) which carry a drive shaft (6). A pump rotor (7), also shown in broken lines, is mounted on drive shaft (6) in pump chamber (8). The rotor (7) is rotatable by conventional means so that cooling water supplied through a feed channel (9) is conveyed by means of vanes (10) of pump rotor (7) into discharge channel (11).

In the embodiment of the invention illustrated in FIG. 1, the pump housing (2) is formed by a cylindrical flat-bottom recess in the body of the internal combustion engine and pump cover (1) is produced from relatively thick sheet metal. As best illustrated in FIG. 1, the pump cover (1) includes a molded part (12) produced from an elastomeric material by injection molding which is vulcanized on the inside surface of the pump cover. The molded part (12) has a conical recess (13) which conforms to the shape of pump rotor (7) and is dimensioned to leave a narrow gap (14) for free rotational movement of pump rotor (7). As illustrated the molded part (12) also has a cylindrical outer cover contour (15) serving as a means for holding and guiding the part in the pump housing (2). Molded part (12) is also designed to function as a seal between housing (2) and pump cover (1) via the action of the pressure exerted on the molded part by the screw joint.

In accordance with another feature of the present invention, seal means are provided between the pump chamber (8) and the support for drive shaft (6) to prevent cooling liquids from migrating along the shaft (6) or tubular projection (3). This seal comprises a collar shaped extension (17) of the molded member (12) which fits into tubular projection (3) of pump cover (1) providing a lining on the seating surface for the sealing ring. The sealing ring thus can be inserted in a leak proof manner by taking advantage of the elasticity of molded member (12) and its projection (17).

Figure 2:
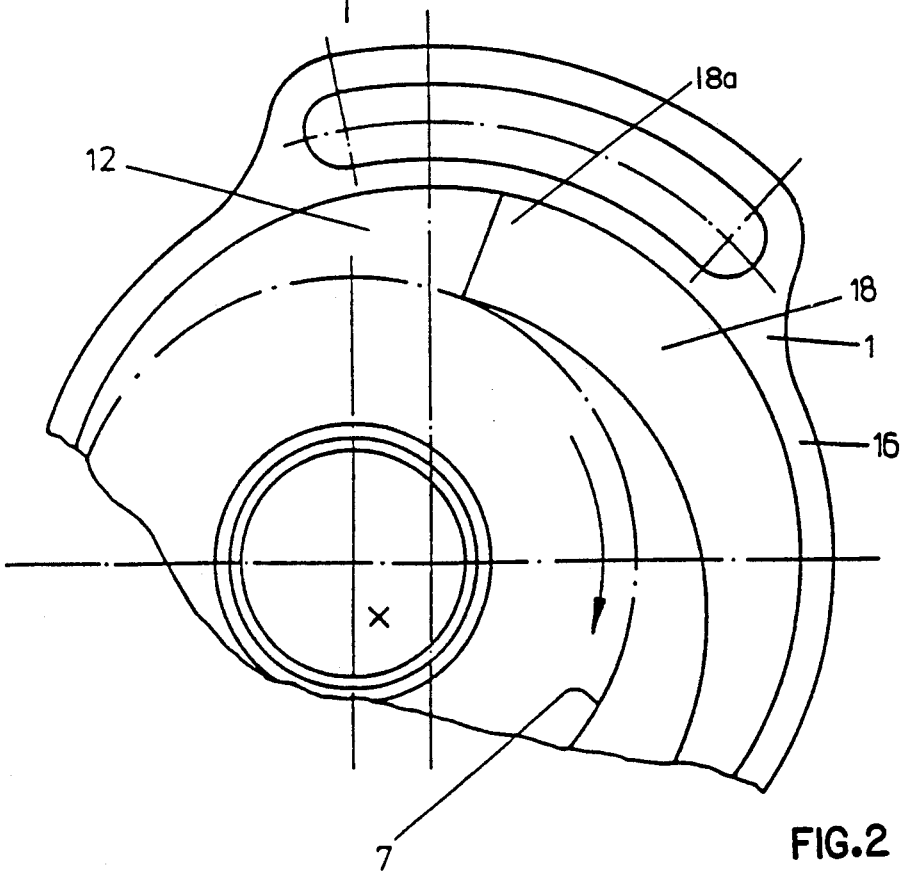
FIG. 2 shows a top view of the pump cover according to FIG. 1.

The output of the pump may be increased significantly by providing a wedge-shaped molded member (18) in the intermediate space between periphery of pump rotor (7) and the inside wall of pump housing (2) as best illustrated in FIG. 2. Accordingly, its wide end (18*a*) points in a direction opposite that which the liquid conveyed by pump rotor (7) is traveling. The resistance thus created in the flow path increases the deflection of cooling liquid into discharge channel (11) and in this manner increases overall pump output. The wedge shaped molded part (18), molded member (12), seal (16), and collar shaped extension (17) may be made of elastomeric material and integrally formed as a one piece unit.

Figure 3:
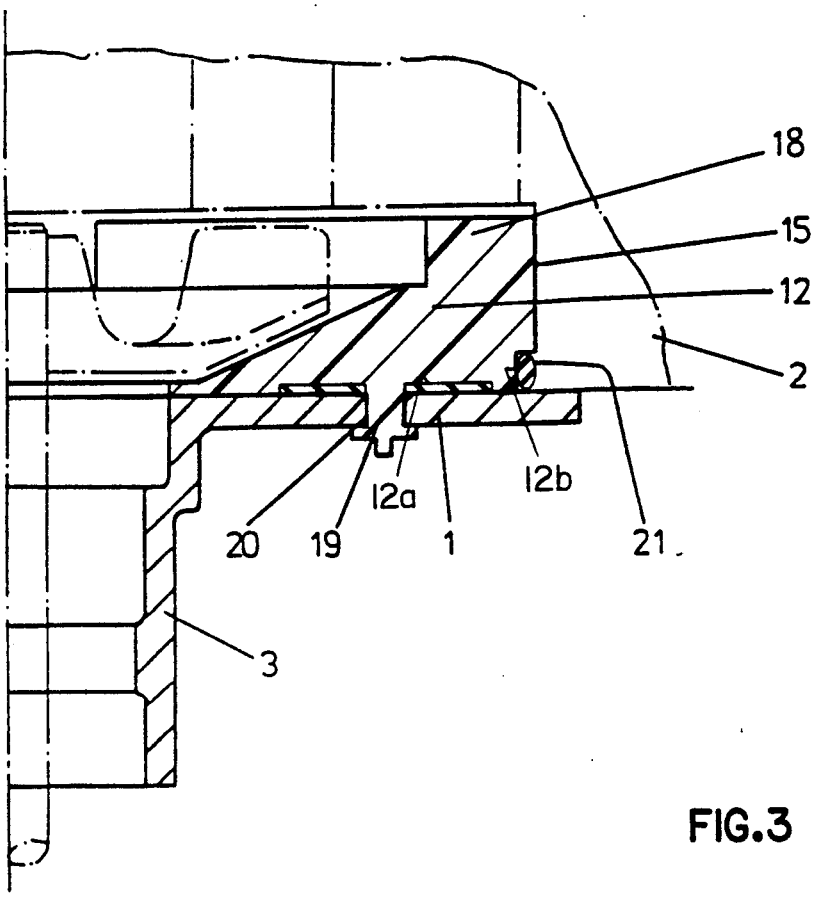
FIG. 3 shows a modified embodiment of the pump cover of FIG. 1.

A modified embodiment of the present invention is illustrated in FIG. 3. In accordance with this embodiment, molded member (12) is made from metal, for example, by sintering, and has a series of inverted T-shaped projections (19) circumferentially spaced which extend through complementary recesses in pump cover (1). The projections are peened over on the outside surface of the pump cover (1) in the manner illustrated. The projections are generally elongated and project beyond the openings to facilitate peening and formation of a head to hold the molded part in place on the pump cover in the manner shown. To ensure a joint between the pump cover (1) and molded member (12) a disc like sealing insert is provided in a corresponding recess (12*a*) in molded part (12). Additionally, a circumferentially extending groove (12*b*) is formed in the outer periphery of molded member (12) for receiving a housing seal (21) in the form of an O-ring which provides a liquid tight seal between the pump cover (1) and the molded member (12) and pump housing (2).

Figure 4:
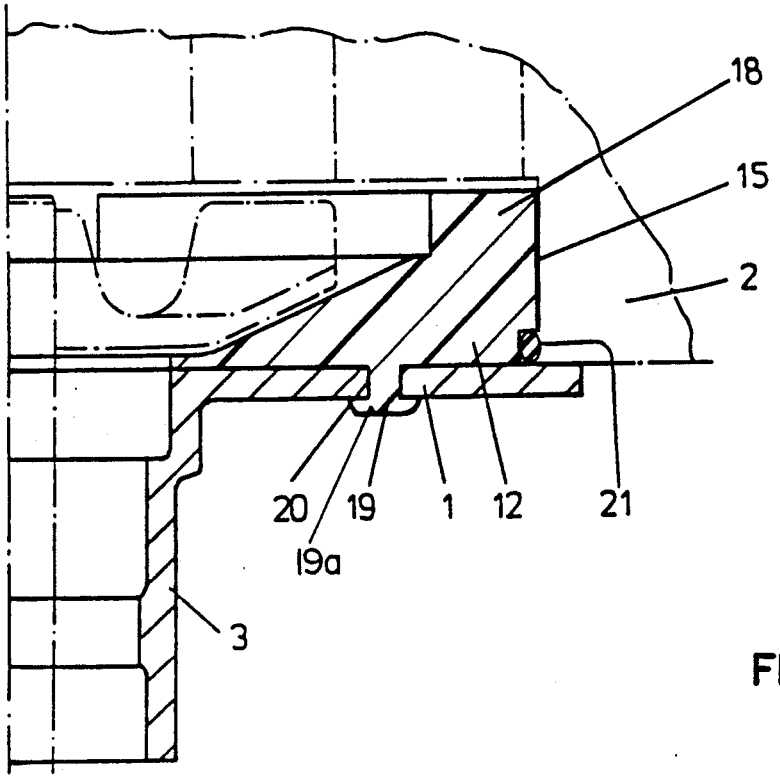
FIG. 4 shows an additional modification of FIG. 1.

A further modification of the present invention is illustrated in FIG. 4. In accordance with this embodiment, the molded member (12) is made of thermoplastic material by injection molding. In this fashion, the projections (19) can be injected into the recess in the pump cover and secured by formation of a head (19*a*) on the outside surface of pump cover (1). The production of molded part (12) and its connection to pump cover (1) can thus be accomplished in a single step by positioning pump cover (1) in the mold used to produce the molded member (12). Accordingly, when the mold is filled with thermoplastic material, the projections (19) automatically are formed in recesses (20) and likewise the head (19*a*) are formed simultaneously. As illustrated, this embodiment also includes a housing seal (21) engageable in a peripheral groove of molded part (12).

Figure 5:
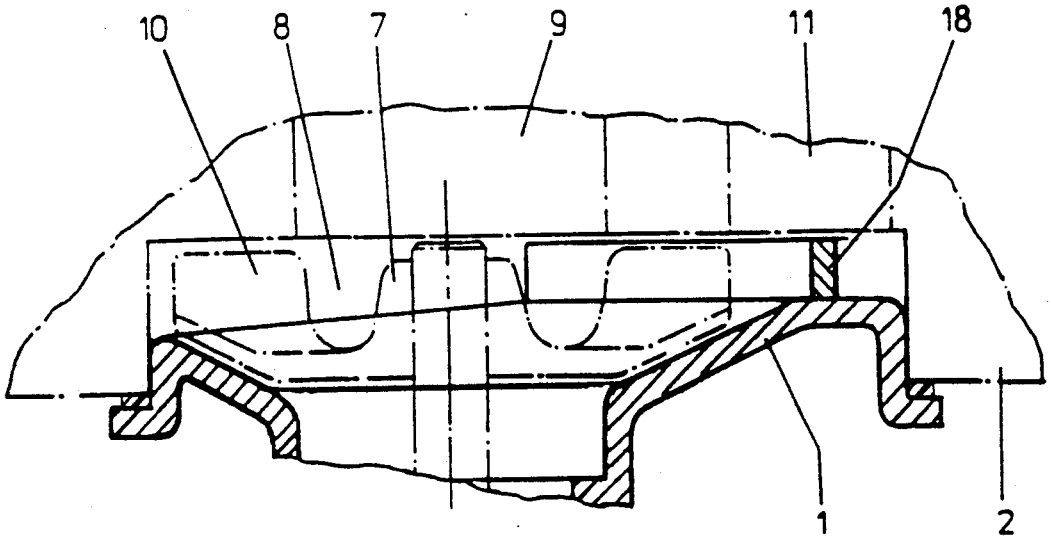
FIG. 5 shows a third embodiment of the invention.
Figure 6:
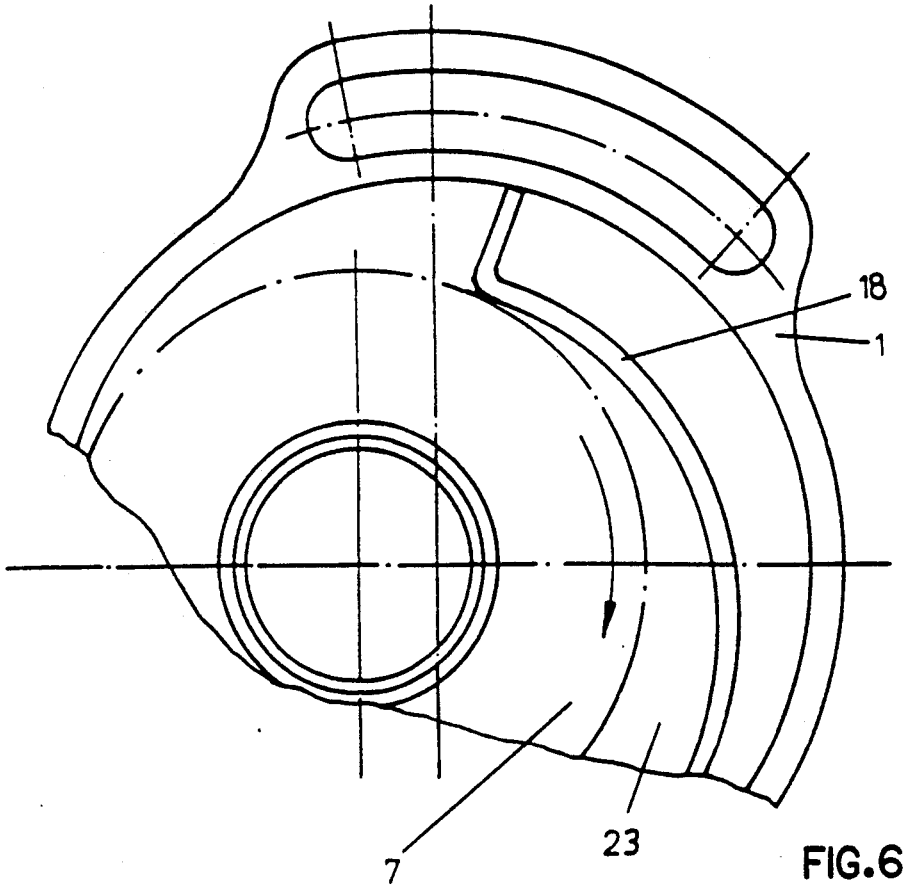
FIG. 6 shows a top view of the pump cover according to FIG. 5.

FIG. 5 and 6 shows still another embodiment of the pump assembly in accordance with the present invention. In this instance the equivalent of the molded member comprises a web (18) made of sheet metal which is secured to pump cover (1) by suitable means such as adhesive, welding or other appropriate method. In accordance with this embodiment of the invention, the pump cover (1) is formed by a simple drawing process to conical shape conforming to the rear contour of the vane (10) of pump rotor (7). The web (18) is eccentric to the pump rotor (7) creating an intermediate space (23) between pump rotor (7) and the web which widens in the direction of rotation of the pump rotor (7).

Even though particular embodiments of the invention have be illustrated and described herein, changes and modifications may be made therein within the scope of the following claims.

We claim:

1. In a liquid pump assembly, a pump housing having a pump chamber with an opening, a drive shaft in the pump chamber mounting a pump rotor, a pump cover sealing the opening of the pump chamber and a single, one piece molded member partially defining the shape of the pump chamber and secured to the inside surface of the pump cover whereby said cover and molded member form in the unassembled state of the cover an integral unit.

2. Pump according to claim 1, wherein said molded member (12,18) is secured both axially and torsionally on the pump cover (1).

3. Pump according to claim 2, wherein said molded member (12,18) includes projections (19) engageable in corresponding recesses (20) in the pump cover (1).

4. Pump according to claim 3, wherein a sealing insert (22) is provided between said molded member (12,18) and the pump cover (1).

5. Pump according to claim 2, wherein said molded member (12,18) consists of a thermosetting plastic.

6. Pump according to claim 2, wherein said molded member (12,18) consists of a thermoplastic material and includes projections (19) of the molded member (12) injected into recesses (20) of the pump cover.

7. Pump according to claim 1, wherein said molded member (12,18) consist of vulcanizable material and is vulcanized onto the inside surface of the pump cover (1).

8. Pump according to claim 1, wherein said pump cover has an outward-facing tubular projection to support the drive shaft, and wherein said molded member (12,18), has a collar-shaped extension (17) to hold a sealing ring and which projects into the tubular projection (3) of the pump cover (1).

9. Pump according to claim 1, wherein the radial outer periphery of said molded member (12,18) is designed to hold a housing seal (21).

10. Pump according to claim 1, wherein the outer radial periphery of said molded member (12,18) is designed to form a seal (16) between the pump housing (2) and the pump cover (1).

11. Pump according to claim 1, including a wedge shaped extension (18) of the molded member which projects into an intermediate space between the peripheral of the pump rotor 7 and the inside wall of the pump housing 2.

12. Pump according to claim 11 wherein said wedge shaped extension 18 tapers in the direction in which the rotor 7 turns.

13. In a liquid pump assembly, a pump housing having a pump chamber with an opening, a drive shaft in the pump chamber mounting a pump rotor, a pump cover sealing the opening of the pump chamber and a single, one piece molded member partially defining the shape of the pump chamber and secured to the inside surface of the pump cover whereby said cover and molded member form in the unassembled state of the cover an integral unit, said molded member including a conical surface conforming to the back face of the pump rotor.

14. In a liquid pump assembly, a pump housing having a pump chamber with an opening, a drive shaft in the pump chamber mounting a pump rotor, a pump cover sealing the opening of the pump chamber and a single, one piece molded member partially defining the shape of the pump chamber and secured to the inside surface of the pump cover whereby said cover and molded member form in the unassembled state of the cover and integral unit, said molded member including a wedged shaped element.

15. In a liquid pump assembly, a pump housing having a pump chamber with an opening, a drive shaft in the pump chamber mounting a pump rotor, a pump cover sealing the opening of the pump chamber and a single, one piece molded member partially defining the shape of the pump chamber and secured to the inside surface of the pump cover whereby said cover and molded member form in the unassembled state of the cover and integral unit, said molded member including peripheral projections defining a radial seal between said pump cover and pump housing and an axial seal between the drive shaft and pump housing.

* * * * *